US011691792B2

(12) United States Patent
Knight

(10) Patent No.: US 11,691,792 B2
(45) Date of Patent: Jul. 4, 2023

(54) RECYCLABLE CONTAINER CLOSURE HAVING INFORMATIONAL AND/OR ANTI-COUNTERFEITING CAPABILITIES

(71) Applicant: RIEKE PACKAGING SYSTEMS LIMITED, Leicestershire (GB)

(72) Inventor: Simon Christopher Knight, South Wales (GB)

(73) Assignee: RIEKE PACKAGING SYSTEMS LIMITED

( * ) Notice: Subject to any disclaimer, the term of this patent is extended or adjusted under 35 U.S.C. 154(b) by 0 days.

(21) Appl. No.: 17/765,482

(22) PCT Filed: Oct. 1, 2020

(86) PCT No.: PCT/EP2020/077601
§ 371 (c)(1),
(2) Date: Mar. 31, 2022

(87) PCT Pub. No.: WO2021/064146
PCT Pub. Date: Apr. 8, 2021

(65) Prior Publication Data

US 2022/0363445 A1 Nov. 17, 2022

Related U.S. Application Data

(60) Provisional application No. 62/908,821, filed on Oct. 1, 2019.

(51) Int. Cl.
*B65D 41/34* (2006.01)
*B65D 41/58* (2006.01)

(52) U.S. Cl.
CPC ..... *B65D 41/3423* (2013.01); *B65D 41/58* (2013.01); *B65D 2203/10* (2013.01)

(58) Field of Classification Search
CPC . B65D 41/3423; B65D 41/58; B65D 2203/10
(Continued)

(56) References Cited

U.S. PATENT DOCUMENTS 9,280,696 B1 3/2016 Fraser
10,399,753 B1 * 9/2019 Migas ..... B65D 41/0421
(Continued)

FOREIGN PATENT DOCUMENTS

DE 102019102213 A1 * 7/2020 ..... B65D 41/045
EP 2865607 4/2015
(Continued)

OTHER PUBLICATIONS

Patent Cooperation Treaty (PCT), International Search Report and Written Opinion for Application PCT/EP2020/077601 filed on Oct. 1, 2020, dated Feb. 18, 2021, International Searching Authority, EP.

*Primary Examiner* — J. Gregory Pickett
*Assistant Examiner* — Niki M Eloshway
(74) *Attorney, Agent, or Firm* — McDonald Hopkins LLC

(57) ABSTRACT

A "smart" closure system, apparatus, and method are described. The closure includes mechanical solution, used in conjunction with wireless technologies and/or web-based or remote authentication, verification, and serialization via a mobile computing device, to provide information about the closure and the contents concealed within that closure. Further, the construction of the closure allows for any and all non-recyclable components of the wireless technologies to be removed so as to enable the closure to be recycled and/or converted to post consumer resin.

14 Claims, 8 Drawing Sheets

(58) Field of Classification Search
USPC ..... 220/252
See application file for complete search history.

(56) References Cited

U.S. PATENT DOCUMENTS

| | | | | |
|---|---|---|---|---|
| 2007/0182564 | A1* | 8/2007 | Abbott | B65D 41/045 340/572.8 |
| 2007/0296599 | A1* | 12/2007 | Wang | B65D 55/028 340/572.8 |
| 2008/0238675 | A1* | 10/2008 | Yang | B65D 55/028 340/572.1 |
| 2008/0309495 | A1* | 12/2008 | Chisholm | G06K 7/10178 340/572.1 |
| 2008/0314900 | A1* | 12/2008 | Biesecker | B65D 41/0492 235/492 |
| 2010/0141384 | A1* | 6/2010 | Chen | G06K 19/041 340/10.1 |

FOREIGN PATENT DOCUMENTS

| | | | | |
|---|---|---|---|---|
| EP | 2991001 | A1 * | 3/2016 | B65D 41/34 |
| GB | 2583948 | A * | 11/2020 | B65D 41/32 |
| JP | 2011213378 | | 10/2011 | |
| WO | WO-2014002971 | A1 * | 1/2014 | B65D 41/3423 |
| WO | WO-2014041325 | A2 * | 3/2014 | B65D 55/028 |
| WO | 2018136927 | | 7/2018 | |
| WO | WO-2021064146 | A1 * | 4/2021 | B65D 41/045 |

* cited by examiner

RECYCLABLE CONTAINER CLOSURE HAVING INFORMATIONAL AND/OR ANTI-COUNTERFEITING CAPABILITIES

CROSS-REFERENCE TO RELATED APPLICATION

This application is a 35 U.S.C. § 371 national stage application of PCT Application No. PCT/EP2020/077601 filed Oct. 1, 2020, which claims priority to U.S. provisional patent application Ser. No. 62/908,821 filed on Oct. 1, 2019, each of which are incorporated by reference in their entireties.

TECHNICAL FIELD

The present invention relates generally to a "smart" closure that can be recycled, including a variety of constructions and methods, all of which impart deterrence to counterfeiting and tampering and/or enable delivery authentication and other information by third parties and end users concerning the origin, quality, and history of the container and, by extension, its contents.

BACKGROUND

Generally speaking, both commodities and more sophisticated products are sometimes subject to tampering and/or counterfeiting. Although basic measures have been developed by manufacturers to address these concerns, recent improvements in printing and other technologies have made it easier for bad actors to copy or otherwise co-opt the packaging of well-known products and/or to improperly reuse that packaging.

A wide variety of product authentication and counterfeit deterrence features and constructions are disclosed in the prior art. An extensive discussion of these earlier features and constructions is provided in U.S. Pat. No. 9,280,696 which issued Mar. 8, 2016. This patent is representative of the state of the art with respect to the enabling digital technologies, but it lacks any substantive disclosure on ways in which these digital technologies can be readily adapted and adopted to suit the specific needs of closures for containers, particularly to the extent it is desired to use such authentication features in combination with more conventional tamper evident features already employed in the closure/container field.

For example, it is known to use a physical barrier, such as breakable plastic wrap and/or foil seal, to serve as evidence of an original/authentically packaged product. If the breakable plastic is compromised, the user will know that particular closure may have been tampered. While these barriers provide a clear indication that the closure has been compromised, they do not and cannot provide any additional information or way to verify where the container has been or what was originally placed inside it.

Separately, barcodes and other visual indicia have been used on packaging containers for identification purposes. These systems generally require dedicated scanners, as well as standardization and/or a third party intervention to establish and maintain rules (e.g., GS1 in Brussels, Belgium coordinates assignment of the twelve digit Universal Product Codes (UPC) that are prevalent in many countries, including the United States). Also, because the barcodes must be predetermined and affixed to individual containers during manufacture, any authentication scheme afforded by these codes is relatively static (i.e., they cannot be easily altered or expanded once the container is filled and delivered by the manufacturer).

Wireless communication tags are also becoming more common in the packaging field. These tags are affixed to a wide range of articles in commerce, thereby enabling wireless communication of information in a centralized database/authentication scheme similar to the aforementioned barcodes and/or by directly communicating with a dedicated device to decode and display information carried by the tag.

Near Field Communication (NFC) tags, Radio Frequency Identification (RFID) tags, and Bluetooth communication devices are specifically used in wireless tags. NFC tags are comparatively small and permit communication with an NFC reader device over distances of up to about 20 cm. RFID tags permit communication with an RFID reader device over larger distances, typically up to 15 m. Both types of wireless tag communicate via electromagnetic (EM) radiation. In contrast, Bluetooth devices require both a programmable chip and a power source to enable communication between the tag and a separate "reader" device.

In recent years, the increased functionality of portable electronics (i.e. mobile phones and tablet PCs) has enabled such devices to be used as readers for communicating with such wireless communication tags. As an example, NFC tags, RFID tags, and Bluetooth devices have been incorporated into various consumable products, thereby enabling consumers to interact with such products using mobile phones.

These more dynamic, wireless systems are responsive to user needs, but they are distinct from and, to the applicant's knowledge, do not attempt to integrate conventional anti-counterfeiting and tampering protections found in closures for containers. A system, method, and apparatus that combined these functions would be welcome, particularly to the extent the authentication features were incorporated in a manner that was not easily accessible, observable, and/or removed and replaced. Specifically, structures to seamlessly accommodate the circuitry, power sources, visual identifiers, and other mechanisms for achieving improved anti-counterfeiting, anti-tampering, and verification systems in a single item are needed.

As a final consideration, many consumer products companies have initiated sustainability campaigns whereby packaging must be manufactured from certain percentages (i.e., at least 67% and up to 95% or even 100%) of post-consumer resins (PCR) and/or be capable of being introduced into PCR recycling systems. PCR resins may include (but are not limited to) certain grades of thermoplastics. Ideally, a single type of PCR resin is employed so that the closure can be introduced into recycling programs without the need to disassemble and/or separate parts, even in situations where the entirety of the closure might be of recyclable materials (e.g., a plastic closure with a metal component must have the metal component must undergo disassembly and sorting to ensure that the metal does not foul the plastic recovery/recycling chain).

Thus, to the extent some of the aforementioned informational or anti-counterfeiting systems rely on integrated chips or structures formed from thermosetting and other difficult-to-recycle materials, the foregoing conventional systems may not meet sustainability requirements.

As an example, international patent publication WO2018/136927 discloses a series of tamper evident closures; however, these closures all require molding the feature into the closure itself. Thus, if an NFC or RFID tag is used, it would be physically and permanently encased between the plastic components of the closure. Notably, other technical solutions proposed in this application dispense entirely with a wireless tag and, instead, rely upon frangible electrical contacts, visual indicia, or other systems that do not provide the inherent simplicity and ease of use provided by the combination of mobile devices (which are now nearly ubiquitous) and wireless tags. Thus, further closure systems for containers with robust, interactive authentication that is explicitly designed for single stream recycling are still needed.

Additionally, closures that rely upon elastomers, thermoset resins, and/or multiple polymers that are difficult to recycle present challenges in terms of providing a truly sustainable and recyclable container/closure combination.

In view of the foregoing, a sustainable "smart" closure (i.e., capable of providing real-time, interactive information about the package and/or product within the closure) is desired. Such a sustainable solution would ideally be made from only PCR materials and/or allow for consumer-based recycling (i.e., no disassembly and separation of components would be required by the consumer).

SUMMARY OF THE INVENTION

The inventions contemplated herein are generally directed toward the goals of: (i) impeding a bad actor's ability to place counterfeit products in a given container; (ii) preventing anyone from tampering with the product carried in that container or, at a minimum, providing easily recognized indicia to an end user that such tampering has occurred; and (iii) enabling any actor within a supply chain (e.g., the manufacturer, the wholesaler, the retailer, and the end user/consumer) to access information and enhance their experience with the product associated with that container. These and other goals may be attained through the use of any combination of the embodiments and other aspects described below. Generally speaking, the closures and containers and associated methods for attaining at least some of these goals are referred to herein as a "smart" or "intelligent" closures.

In some embodiments, the container is fitted with a closure that captures a tag with tracking and/or identification indicia via a wirelessly generated signals for near field communications systems (NFC). As used herein, near field communication may encompass NFC, RFID, and other passive technologies and protocols. In such passive technologies, a portable (mobile) computing device is able to detect a signal generated when the device is moved within proximity of the tag. Based on the signal generated, the mobile device then communicates with remote servers to determine certain informational traits about the product enclosed by the container/closure (e.g., manufacturing date, authenticity, product expiration, etc.). Additionally, physical structure(s) in that container/closure impedes tampering and provides an indication once the closure is initially opened or removed by physically altering the tag itself.

The disclosed embodiments enable consumer engagement (e.g., establishing profiles, providing reminders, etc.), as well as the ability to measure, track, and report on products via the active features described herein. In turn, the various embodiments and aspects may promote consumer confidence, enhance logistics operations, verify product quality, provide an opportunity for users to voluntarily provide additional information and/or create profiles which may be paired to the product and its use.

Some aspects of our proposals are set out in the appended claims. In particular, one aspect of our proposals is a smart closure, rotatably attachable to a container, comprising:

- a cap having a panel, a peripheral skirt extending axially away from a bottom facing of the panel and a sealing flange, plate engagement features, and a plurality of tag engagement posts all positioned on the bottom facing, said sealing flange arranged coaxially within the skirt and said plate engagement features and plurality of tag engagement posts arranged within an area defined by the sealing flange;
- a sealing plate having at least one peripheral stopper to engage a corresponding stopper formed on a container and cap engagement features provided on a top facing, said sealing plate sized to be received within the skirt;
- a wireless tag having at least one frangible appendage, said wireless tag positioned between the cap and the plate so that the tag is carried on the engagement posts;
- wherein the cap and sealing plate are coupled together via the cap and plate engagement features to form a closure with the wireless tag held between the cap and the sealing plate; and wherein, after the closure has been tightened onto a container, the frangible appendage ruptures when the closure is thereafter loosened by rotation relative to the container. Some preferred features are in the dependent claims.

Specific reference is made to the appended claims, drawings, and description below, all of which disclose various aspects and elements of the invention. While specific embodiments are identified, it will be understood that elements from one described aspect may be combined with those from a separately identified aspect. In the same manner, a person of ordinary skill will have the requisite understanding of common processes, components, and methods, and this description is intended to encompass and disclose such common aspects even if they are not expressly identified herein.

DESCRIPTION OF THE DRAWINGS

Operation of the invention may be better understood by reference to the detailed description taken in connection with the following illustrations. These appended drawings form part of this specification, and any information on/in the drawings is both literally encompassed (i.e., the actual stated values) and relatively encompassed (e.g., ratios for respective dimensions of parts). In the same manner, the relative positioning and relationship of the components as shown in these drawings, as well as their function, shape, dimensions, and appearance, may all further inform certain aspects of the invention as if fully rewritten herein. Unless otherwise stated, all dimensions in the drawings are with reference to inches, and any printed information on/in the drawings form part of this written disclosure.

In the drawings and attachments, all of which are incorporated as part of this disclosure:

FIGS. 1A and 1B are cross-sectional side views of a closure and container connection, illustrating the attachment of the components within the closure and their connection to the container, while

FIG. 4A is a perspective view of the underside of the fully assembled closure, while

DETAILED DESCRIPTION

Reference will now be made in detail to exemplary embodiments of the present invention, examples of which are illustrated in the accompanying drawings. It is to be understood that other embodiments may be utilized and structural and functional changes may be made without departing from the respective scope of the invention. As such, the following description is presented by way of illustration only and should not limit in any way the various alternatives and modifications that may be made to the illustrated embodiments and still be within the spirit and scope of the invention.

As used herein, the words "example" and "exemplary" mean an instance, or illustration. The words "example" or "exemplary" do not indicate a key or preferred aspect or embodiment. The word "or" is intended to be inclusive rather an exclusive, unless context suggests otherwise. As an example, the phrase "A employs B or C," includes any inclusive permutation (e.g., A employs B; A employs C; or A employs both B and C). As another matter, the articles "a" and "an" are generally intended to mean "one or more" unless context suggest otherwise.

A closure for sealing a container is contemplated. The container and closure combination may have any number of features that are commonly encountered in this field, including but not limited to a screw fit arrangement between the closure and the container to allow the closure to selectively removed and refitted. When fitted, the combination may form a watertight and/or hermetic seal.

The descriptions and drawings in this disclosure, and any written matter within the drawings should be deemed to be reproduced as part of this specification. In all cases, a closure is affixed to a container, thereby necessitating a cooperating connection and disconnection between these components. Significantly, the initial rotation to secure/affix the closure may provide sufficient axial compression (relative to the common vertical axis of the components and/or relative to the motion by which the closure is lifted away from the container). In either instance, this axial force locks the components in place while, conversely, the initial attempt to loosen and remove the closure engages, initiates, or otherwise enables the desired functionality with respect to anti-counterfeiting, anti-tampering, authentication/verification, or other informational purposes. Alternatively, the initial manufacture of the closure and/or during its attachment to the container can achieve this purposes.

The invention relies upon a three piece closure system wherein a tag is captured and sealed between a cap and closure plate. Generally speaking, the functionality delivered by this arrangement can be characterized according to the groupings discussed below. It will be understood that these groupings are not mutually exclusive and, in some instances, a single component can be by several different groupings.

Mechanical Capture and/or Release

Figure 1A:
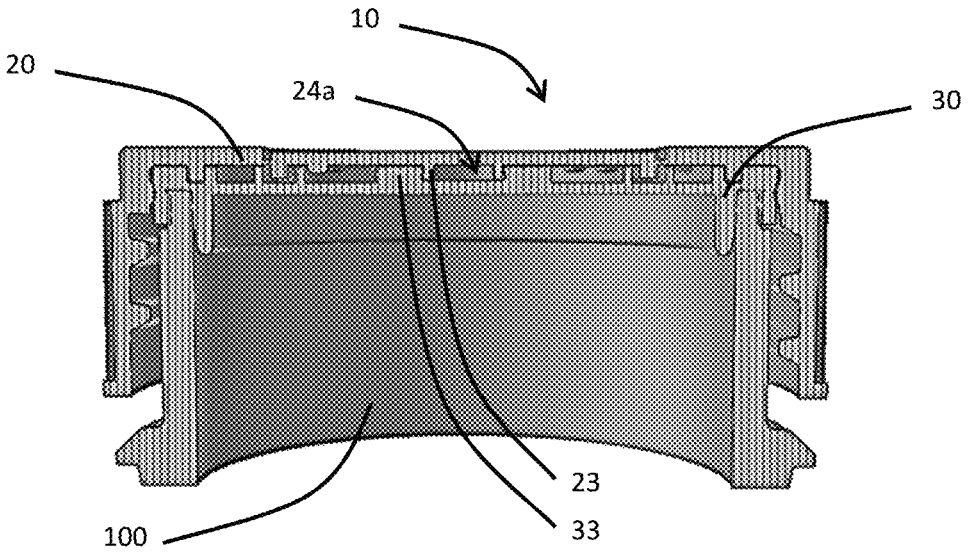
Figure 1B:
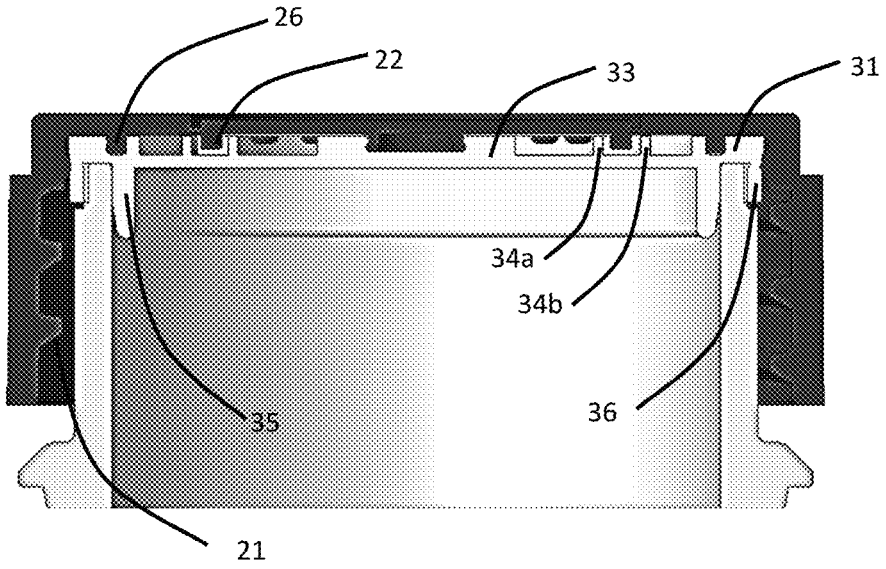
Figure 2:
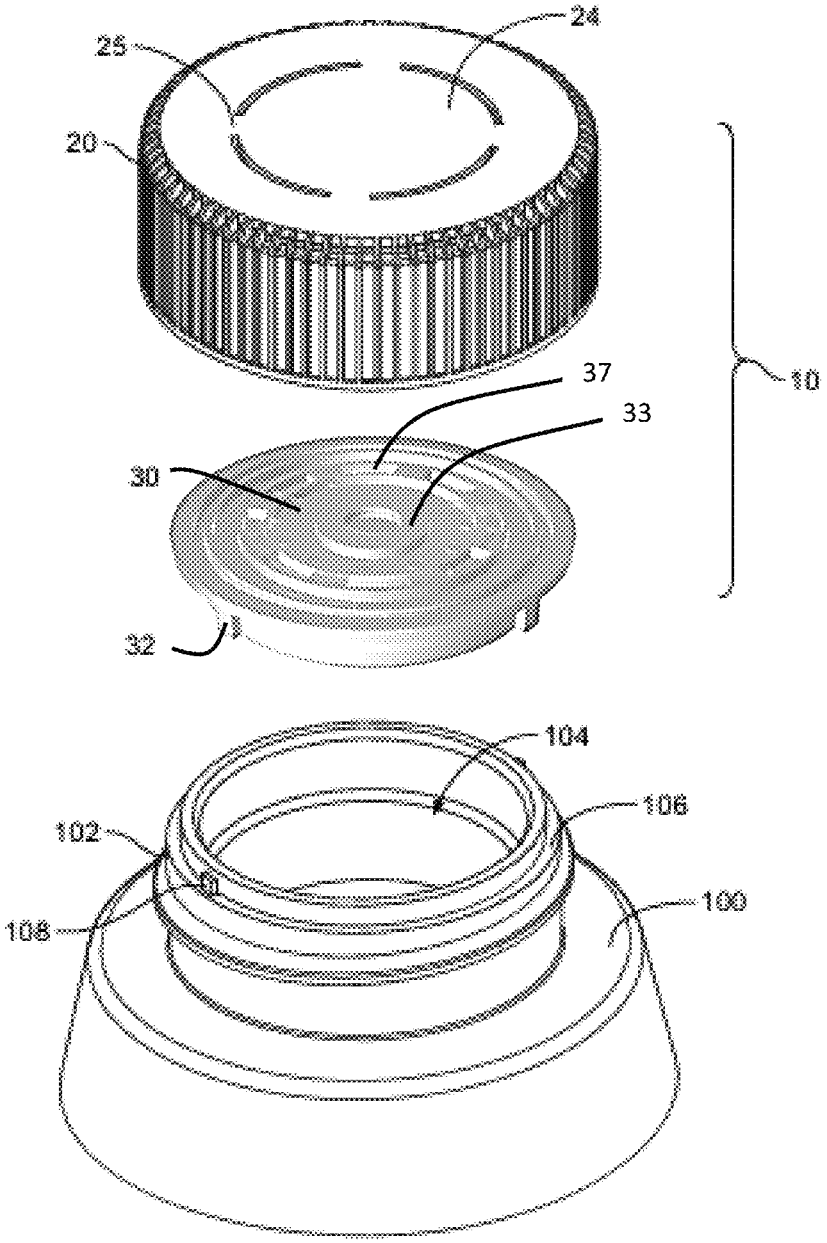
FIG. 2 is an exploded view of these elements but with the wireless tag omitted.
Figure 3:
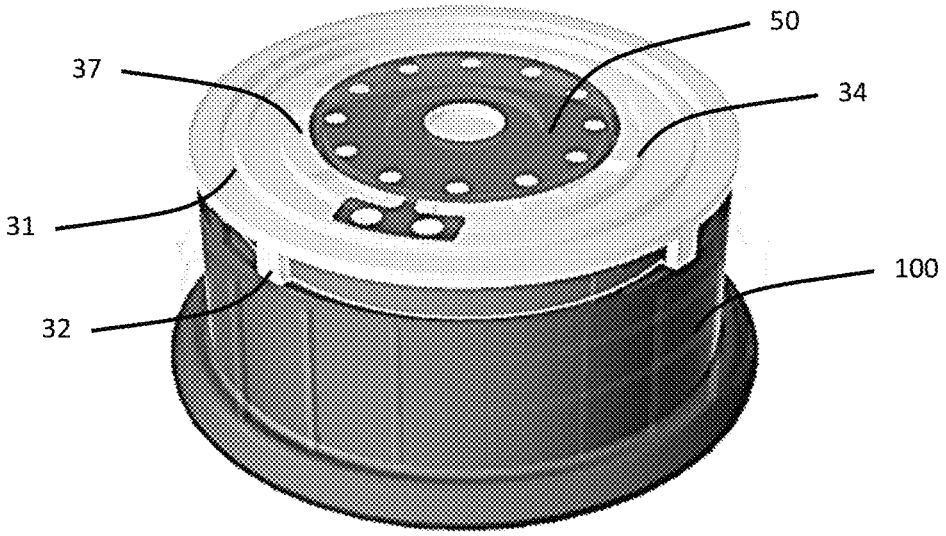
FIG. 3 is an isolated sectional perspective view showing only the closure plate and the container (i.e., with the cap omitted).
Figure 4A:
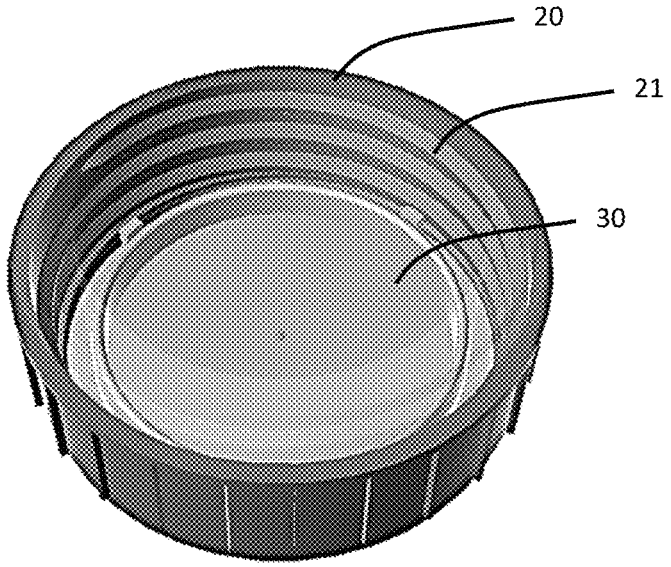

With reference to the Figures, a screw top closure 10 includes two sealing components. An outermost cap 20 includes threads, flanges, tabs, or other means to affix cap 20 to container 100 with corresponding structure on neck 102, thereby sealing the container opening 104. Along its inner facing, cap 20 couples to a sealing plate 30 with anti-back off ribs 32 (as seen in FIGS. 2-4) to limit the rotation of the inner disk 30 relative to the container neck 102.

Cap 20 is of a conventional construction. That is, a skirt or cylindrical sidewall 28*a* extends axially downward from a top panel 28*b*. Threads may be formed on an inner facing of skirt 28*a*, and the overall dimensions of the cap 20 are sized and shaped to rotatably engage and seal a container neck, as described below. Additional features are provided on the bottom and, optionally, top facings of panel 28*b* to accommodate the authentication features described below.

When the cap 20 is fitted to the container 100, the threads 21 (or other engagement mechanisms) secure the closure 10 to the container 100 by way of corresponding threads 106. The back-off ribs 32 come into contact with corresponding posts, ribs, or stops 108 formed near the opening 104 along the neck 102, while the inner disk 30 itself is compressed against the inner facing (i.e., the underside) of the cap 20.

Sealing flanges or skirts 35,36 extend downward from plate 30 to define a receiving gap between them. The edge of container neck 102 is received within this gap so that, as the closure 10 is tightened, container 100 and closure 10 form a sealed fit. Flanges 35,36 may be formed orthogonally to the plane of plate 30 and/or they may include tapered edges disposed toward the container edge so as to create a plug seal thereto.

On an opposing facing of plate 30 relative to flanges 35,36 (i.e., the top facing), a flat engagement surface 31 receives ribbed wall or flange 26, which in this embodiment extends around the underside of the cap top panel 28*b*. Flange or rib 26 snap fits or otherwise seals within a groove 31*a* formed in surface 31 to ensure a moisture-proof seal between the underside of the cap 20 and the top of the plate 30. Notably, tag 50 is disposed concentrically within an annular surface or circular recess 38 defined by wall 34 (i.e., walls 34*a* and 34*b* in which gaps 37 are formed) and/or the ribs 22 received in the gaps as discussed below.

The ribs 32 need only have a thickness of less than 3.00 mm (as measured in a transverse plane relative to the longitudinal axis of the container), and more preferably less than 2.50 mm or even less than 2.0 mm, although in all cases the thickness of the ribs will be discernibly greater than the thickness of the container itself (i.e., its average thickness and/or its average thickness within the neck area). In this manner, significant savings can be realized owing to the reduced volume of materials required in comparison to known container designs employing backoff ribs for other purposes.

Fitting or guide cylinder 23 is formed along a central portion of the inner facing of the cap 20. Cylinder 23 may be hollow so as to define a recess 24*a*. Cylinder or post 23 is urged into or around a receptacle 33 formed on the corresponding top facing of the plate 30. Thus, when the closure 10 is initially tightened/affixed onto the container 100, the post 23 is urged into the receptacle 33 to hold the cap 20 and plate 30 together. By holding the cap 20 and plate 30 together in this fashion, the anti-rotation ribs 22 (as described below) engage effectively.

As seen in FIGS. 2, 3, 4A, and 4B, additional anti-rotation ribs 22 are provided on the inner facing of the cap 20. Ribs 22 are received within corresponding arcuate gaps 37 defined between raised wall sections 34*a*, 34*b*, in this embodiment extending up from plate 30 in annular arrangement. Ribs 22 may possess ramped or wedge-like shapes to allow rotation in one direction but not the reverse direction. In this manner, once the disc 30 rotates relative to the cap 20, it cannot return to its original position. A series of posts 27 extend from the underside of cap 20 to secure and engage tag 50, as described below.

When cap 20 is urged toward sealing plate 30 by rotation of the screw threads, the cylinder 23 and receptacle 33 engage in a snap fit, that may be further enabled by radially formed bead and groove structures on cylinder 23 and receptacle 33 (similar features can be provided on the groove in surface 31 and/or flange 26). In this manner, cap 20 becomes coupled to plate 30 because the ribs 32 hold the plate 30 in place against the container 100, so as to permit the cap 20 to press down.

Meanwhile the fit of ribs 22 within gaps 37 provide a limited range of rotary motion between these components (i.e., the range of the arc defined by the gap 37). Thus, when the closure 10 is unscrewed/disengaged from the container 100 for the first time, ribs 22 allow for a limited range of motion between cap 20 and plate 30, after which point, they then move in unison as the cap is unscrewed. However, the limited rotation of these components is sufficient to cause tag 50 to become compromised, as will be described in greater detail below.

Figure 4B:
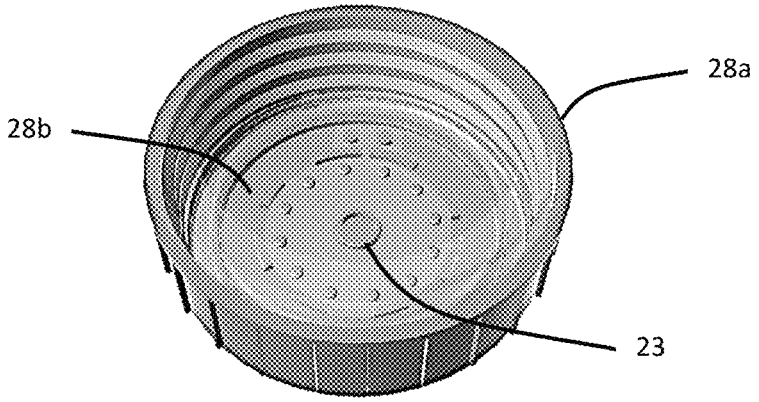
FIG. 4B is a similar view showing only the cap (i.e., with the plate and tag omitted).
Figure 5A:
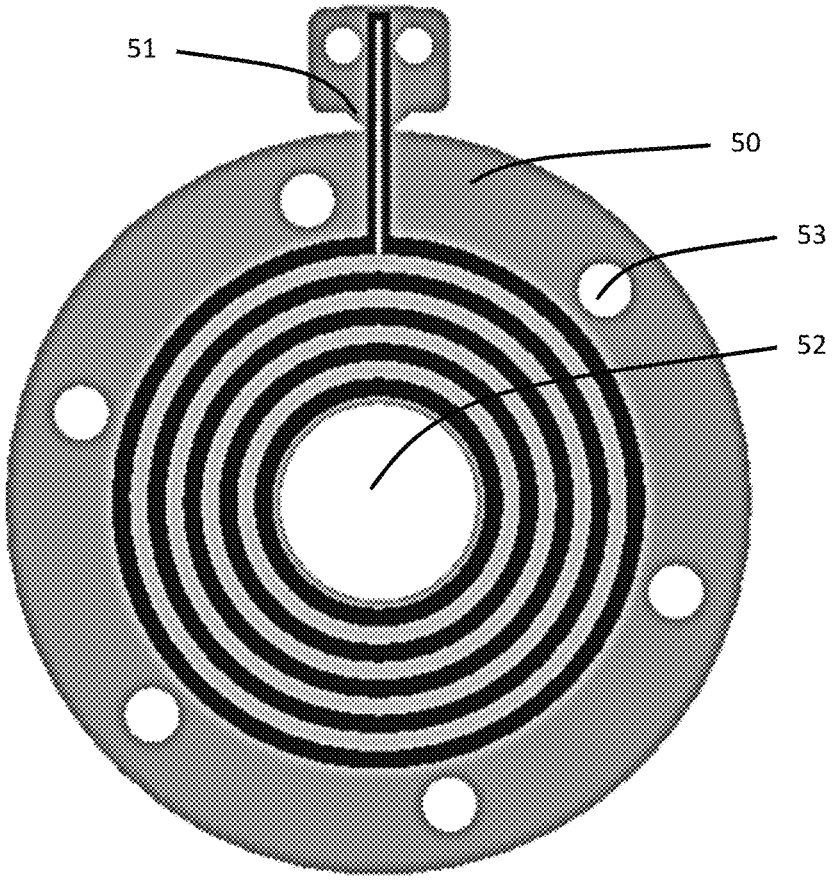
FIGS. 5A is a top plan view of the tag, while FIGS. 5B and 5C showing the tag seated within the cap with the plate omitted. The former is a plan view of the underside of the cap while the latter depicts a perspective view.
Figure 5B:
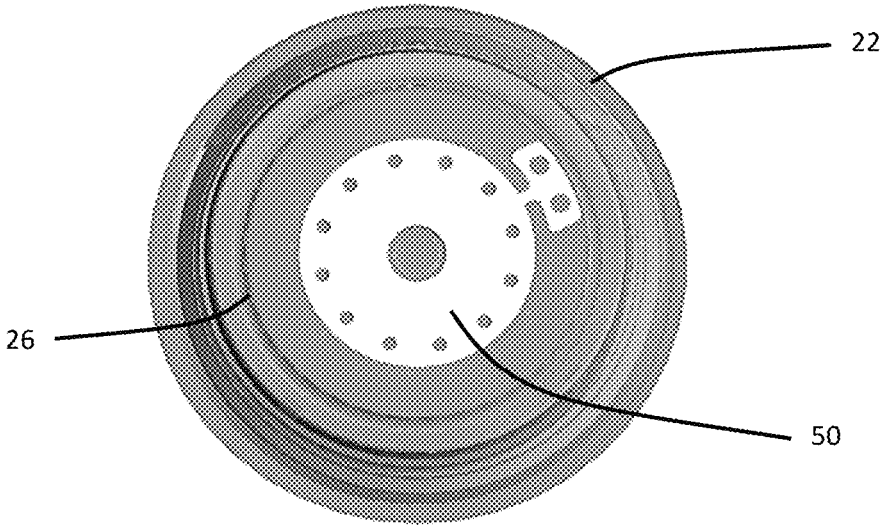
Figure 5C:
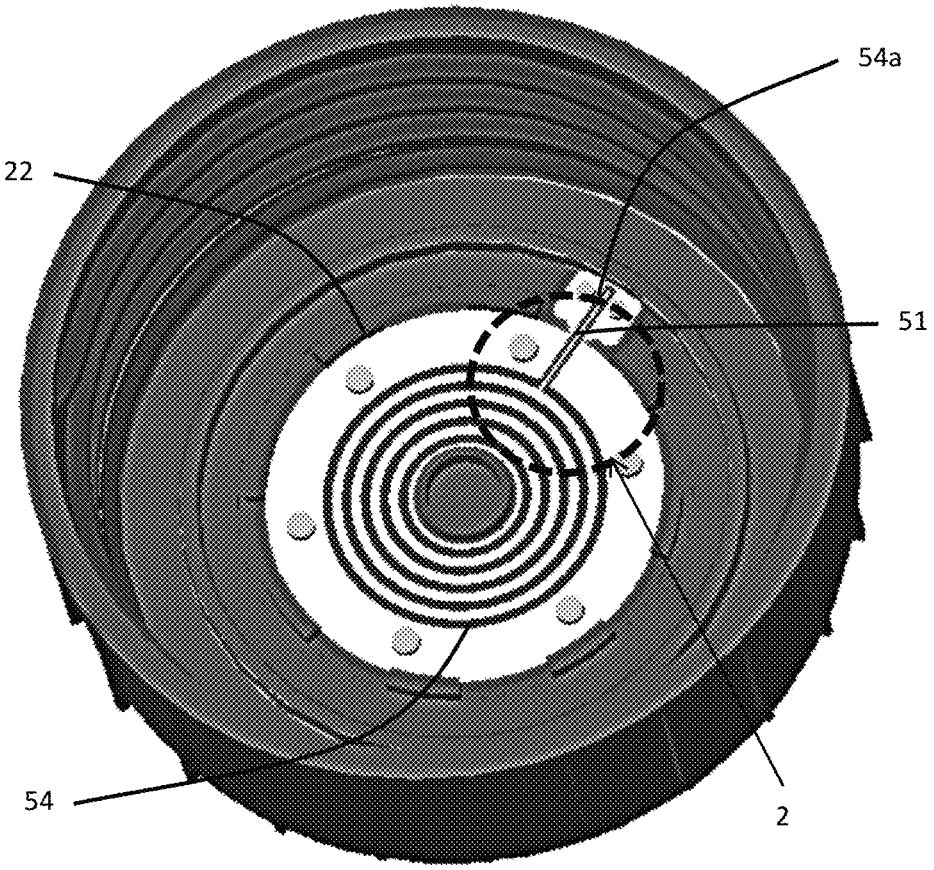
Figure 6A:
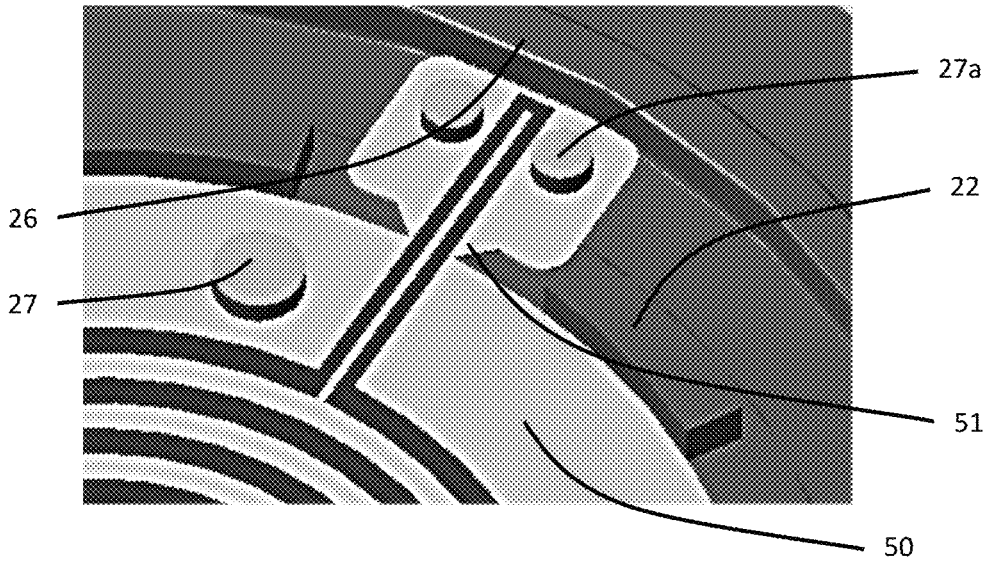
FIGS. 6A and FIG. 6B are perspective views of callout 2 in FIG. 5C, with the former suggesting wider spacing for larger tolerance in indexing and seating the tag within the cap and the latter showing a narrow spacing of ribs to ensure breakage of the appendage.
Figure 6B:
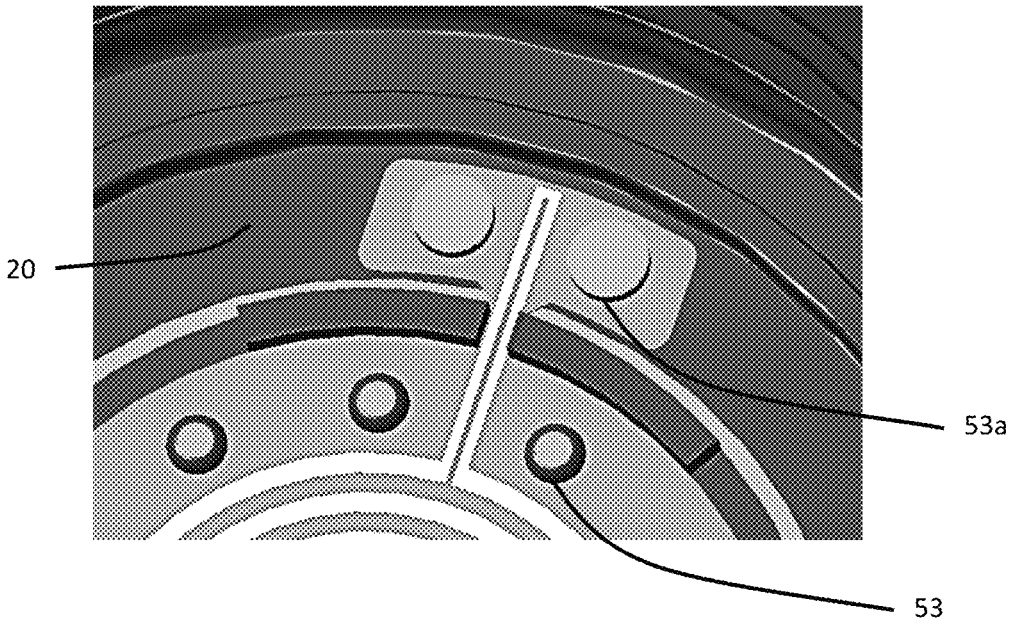
Figure 7:
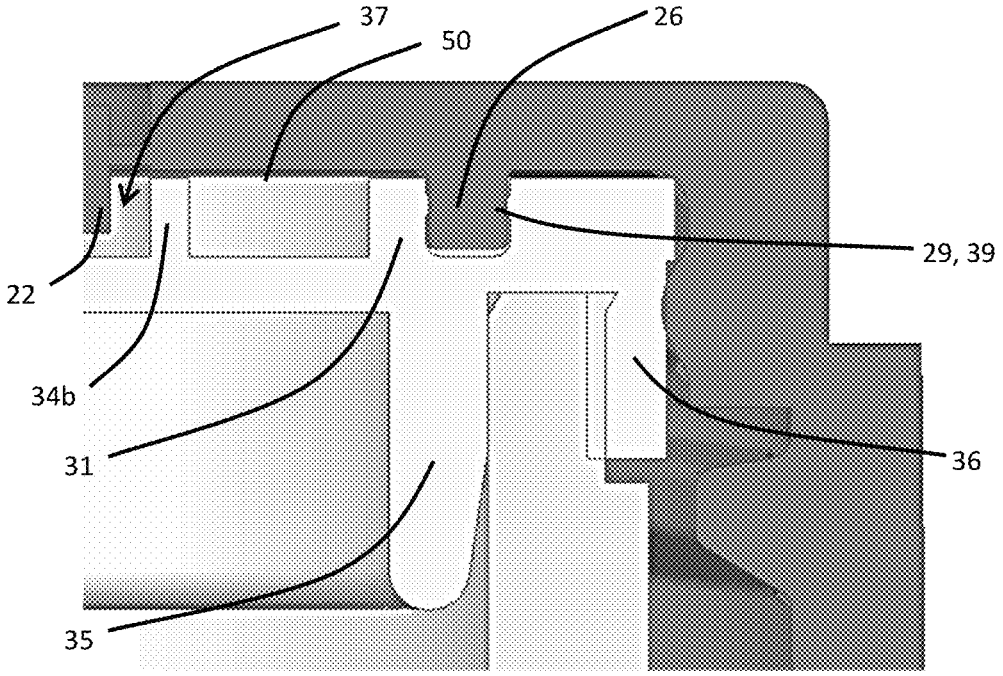
FIG. 7 is a cross-sectional perspective view of the engagement and interface between the cap, the plate, and the container neck.
Figure 8:
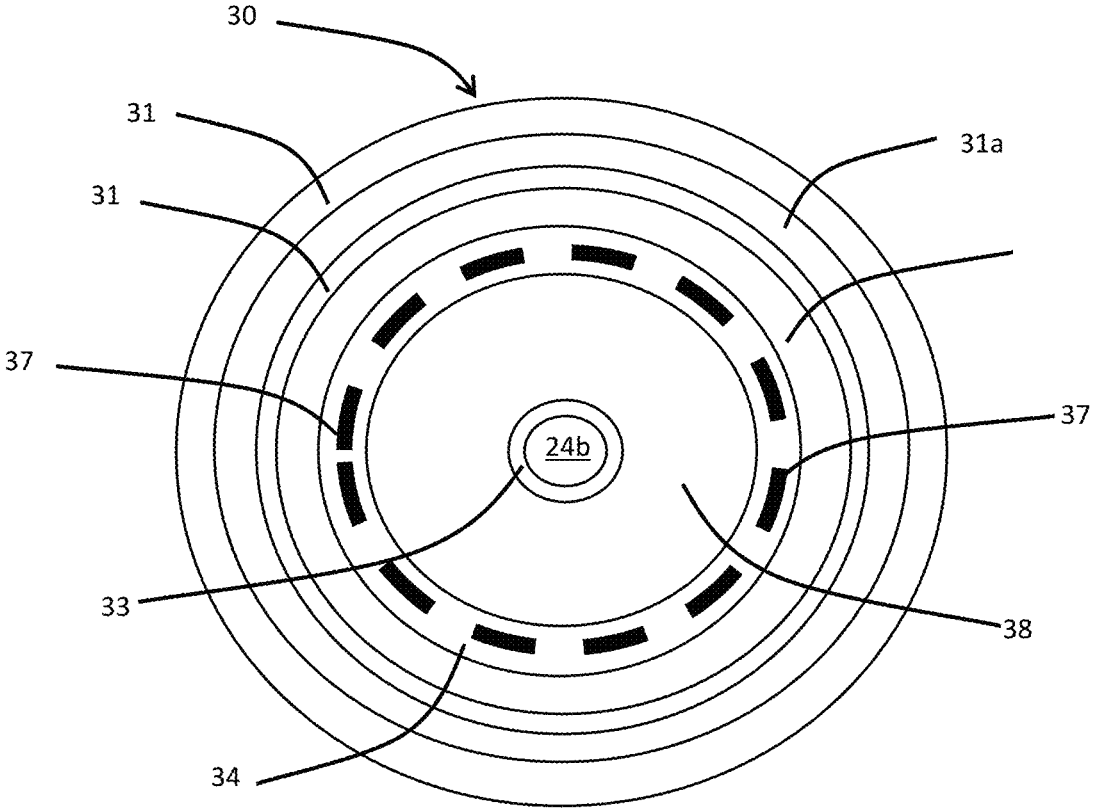
FIG. 8 is a top plan view of the top facing of the plate.

A wireless tag 50 is positioned within the diameter defined by flange 26 beneath the cap 20. Tag 50 has a circular shape with one or more appendages 51 sized to be received between ribs 22 and gaps 37. A central aperture 52 receives and fits around cylinder 23 and receptacle 33. Peripheral apertures 53 are sized and spaced apart to receive posts 27. In this manner, tag 50 is held between cap 20 and plate 30, but moves in concert with cap 20 owing to the action of posts 27 and apertures 53: FIGS. 4B and 6A.

In some embodiments, such as shown, a series of axially spaced bead and groove or other fitments 29 (on the cap 20) and 39 (on the plate 30) are disposed on one or both of the radial surface of the cylinder 23/receptacle 33 combination and/or the flange 26/groove of surface 31 combination. In this manner, initial coupling assembly of the cap 20 and plate 30 can occur by engaging a first set of fitments 29*a*, 39*a*. Then, as the closure 10 is tightened onto container 100, the first fitments 29*a*, 39*a* disengage and the second set 29*b*, 39*b* engage. In all instances, fitments 29, 39 are sufficient to maintain cap 20 and plate 30 in a coupled arrangement, preferably sufficient to prevent moisture ingress and/or other access to the tag 50 captured there between. Thus, these fitments provide first and second axially-spaced engagement positions available between the cap and plate, each being a stably coupled position.

Tag 50 is positioned above flattened section 38 of the plate 30 and beneath and within the circular shape defined by ribs 22 on the underside of cap 20. Apertures 53 also align with posts 27 so that the tag 50 is received, carried on, and moves in concert with cap 20, particularly as it is rotated relative to the container 100 and, in some limited instances, the plate 30.

In some aspects, the posts 27 may be arranged at regular intervals around within the circumferential area enclosed and defined by flange 26. These posts are preferably arranged in a circular pattern, although one or more could be offset to verify indexing and alignment of the tag 50. Further, the position of the posts 27 may partially or completely coincide with the wall 34 so that a portion of the cap 20 and a portion of the plate 30 are compressing the tag 50 to hold it in place after the closure is 10 assembled and, further, after the closure 10 is tightened onto a container neck. Additional posts 27*a* to cooperate with apertures 53*a* formed in the appendage region 51 and these additional posts 27*a* could also be positioned to compress the tag 50. In the same manner, wall 34 could be augmented by separated raised portions on the top facing of plate 30 and/or the wall 34 need not be uniform or strictly circular in its shape.

The appendage or bridge 51 of the tag 50 rests between gaps 37 on a flat surface of wall 34. Some or all of the periphery of tag 50 may also rest on wall 34*a* on an outer edge and receptacle 33 on an inner edge. Thus, when the cap 20 is unscrewed, the ribs 22 will eventually catch on a surface of the gaps 37 so as to cause the cap 20 and plate 30 to move together. However, in the space prior to this, the posts 27 will first cause the tag 50 to rotate only with the cap 20, thereby causing appendage 51 to break off.

The breaking off of appendage 51 changes the length of the contiguous wire/coil present in the tag 50. In turn, when exposed to an appropriate reading device, this change in length will result in a detectable change in the wireless signals produced and subsequently detected by the reader. When coupled with coded information specific to the cap/tag, this change enables the reading device (in communication with a remote data server) to distinguish between the original tag 50 (as it was initially manufactured) and after the closure has been initially opened. This distinction allows of the closure as original or compromised, while the unique identifying information specific to the tag itself allows for authentication of the product and the other various informational and anti-counterfeiting aspects described herein.

This arrangement allows and even encourages the use of tag 50 to be printed on paper or polymer sheets, the thickness of which ensures appendage(s) 51 are sufficiently frangible to produce the desired distinction in signal output for the tag 50. As implied, a series of appendages 51 could be provided along the periphery, with appropriate alterations in the spacing of ribs 22 and gaps 37, so as to allow for control of the signal output required to detect opening/tampering of the container.

Further the arrangement avoids the need for delicate, frangible bridges as might be found in tamper evident strips and earlier iterations of closures having a tag imprinted on such frangible items. In fact, once the tag 50 is seated on the posts 27 of cap 20 and encased by snap-fitting plate 30 thereon, the resultant closure 10 (i.e., the cap 20 and plate 30, but excluding the container 100) is relatively indistinguishable from conventional screw cap closures. In this manner, the inventive closure 10 can serve as a direct replacement in closing operations and without the worry of maintaining the integrity of frangible components.

While a series of ribs 22 and gaps 37 are shown, a single set of interfacing components could accomplish this same end. Further, while arcuate ribs 22 and gaps 37 are shown, ribs could be provided as simple posts or other structures, while the gaps could be formed as slots.

Figure 9:
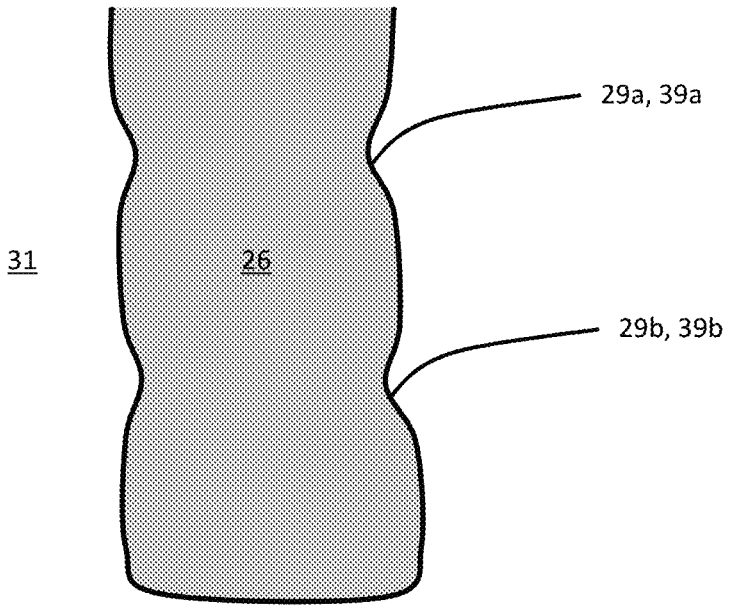
FIG. 9 is a schematic sectional side view showing an exemplary arrangement for axially spaced engagement features that attach and seal the cap to the plate in a moisture proof manner.

In some embodiments, adhesives (and, more preferably, water or solvent soluble adhesives) could augment or replace the engagement of features 29, 39. Also, while beads and grooves are illustrated, features 29, 39 could be formed as discrete projections and apertures, ramps, or other commonly used force or interference fittings found in closures. When used, axially spaced apart features 29*a*, 39*a* and 29*b*, 39*b* can be of the same or different construction, with it understood that the initial engagement (in FIG. 9, pairing 29*a*, 39*a*) should be formed to allow for a release, whereas 29*b*, 39*b* need not release after engagement. To that end, ratchet-tooth style fittings may be appropriate where a more permanent attachment is required.

There are numerous advantages to the use of specially formed paper or resin tags 50. Foremost, such tags 50 can be printed by conventional means en masse and then introduced to the closure 10 during manufacture/assembly. The spacing of the apertures 53 and posts 27 can be specialized (e.g., not uniform) so as to allow for alignment and indexing of the appendage(s) 51 in their proper position. Tags 50 as described herein also avoid the need for specialized molding techniques (e.g., insert molding). Also, tags can be coded so as to identify individual closures from one another, on the basis of the intended use, time of manufacture, location/source, serial or lot numbers, SKUs, brands, sellers, intended contents, and/or any of a variety of other pertinent variables.

Tags 50 can and will naturally fall out of the closure 10 when it is crushed as part of routine recycling operations. Once released from its encasement, the use of soluble adhesives (as compared to conventional adhesives) helps to ensure the tag 50 is fully separated and can be recovered or disposed of by floatation, gravity/density sorting, or selective combustion/incineration.

A serialization number may be provided on the cap 20; for example, within the central section 24. The number may serve as a unique identifier for that cap/container combination (i.e., the product), as well as to accomplish any of the other objects described below. The number may be printed, etched, stamped, labeled, or integrally formed (e.g., by way of one or two shot molding). In place of or in addition to a serialization number, other optical indicators (as described below) can be incorporated in a similar manner.

In some aspects, the ideal thickness of the back off ribs 108 provided on the container neck can be expressed relative to as a ratio in comparison to the standardized dimensions of bottle openings, as defined by the Glass Packaging Institute (GPI) and/or Society of Plastics Industry (SPI). The thickness of the ribs may be any one one-hundredth integer between 1.00 mm and 3.00 mm, while the inner diameter may be 400, 410, 415, 425, 430, 2030, or 2035 sized. Any combination of these disclosed aspects are included. Ribs 108 cooperate with ribs 32 to create the necessary resistance to detach bridge 51, whereas ribs 22 cooperate with features on the central section 24 and/or cap 20 for a similar purpose, all of which will be described below.

The inner facing of the cap also contains anti-rotation ribs and an optional snap fit post that is received within a recess on the inner disk (conversely, the disk may be provided with a post and the cap with a corresponding recess). In either case, these structures on the inner facing of the cap cooperate to allow only partial rotation of the inner disk when the closure is tightened and then released (e.g., via rotation and/or torque). Further, because the initial tightening causes the post to be snap-fitted into the recess, this partial rotation is effectively irreversible (i.e., the cap and inner disk cannot easily be reset to their original positions).

In addition to the tag 50, separate indicators on the cap and the inner disk can be included to allow the user to quickly verify that the closure has been previously removed from the container. In turn, the user can be assured that the container has not been tampered with or surreptitiously refilled.

The indicators could be as simple as arrows that are aligned when the closure is secured onto the container. Thus, a gap or series of gaps may be visible on the outer facing of the cap/closure, and the arrows would not be aligned when the closure is initially released from the container.

Alternatively, the indicator could be a stress-induced structure that is at least temporarily attached to the cap and inner disk. The stress-induced structure would break, change color, or provide some other visual when sufficient rotation/torque is applied to initially release the closure. Any number of polymers may be suitable to provide stress-induced indications contemplated herein.

While some of the foregoing embodiments rely upon visual recognition by the end user, other (usually machine-readable) indicators could be employed. For example, bar codes, QR codes, and other similar optically scanned arrays could be printed on a facing of the disk so that the code is viewable when the closure is sealed. After torque is applied, the disk rotates so that codes cannot be seen. Thus, by relying upon a scanner technology (e.g., an application downloaded to a camera-based device), a user can scan the code and learn from the application as to the nature of the product associated with that code. As will be discussed below, additional technologies could allow for remote interaction (e.g., via a wireless data network) to provide real-time updates and/or to communicate to and update a remotely based server that the product associated with that code has undergone some sort of transformation. In either case, the optical indicator could be used to proactively inform the user as to the contents and history of the closure/container assembly before it is first opened.

Conversely, the optical indicator could be initially concealed from a viewing window until after the product was opened. In this manner, the user is only able to access information after the closure was opened/compromised. In this instance, the user would need to be aware of and informed so as to avoid purchasing a product where the optical indicator was initially visible.

Wireless Detection Mechanisms

Wireless technologies, including radio frequency identification, near-field communications devices and protocols, and magnetic, capacitive, inductive, or other non-contact detection systems could be provided within the closure to serve the goals defined herein. In these embodiments, the closure needs only to be proximate to a detector (e.g., an end user's hand held or mobile computing device). The detector itself then displays or otherwise communicates information captured by the wireless technology.

Notably, the wireless technology might be as simple as a unique and/or serialized identifier. This identifier is associated with a database which then captures more descriptive information provided or maintained by the manufacturer or retailer. Alternatively, the technology may be programmed to communicate the desired information directly (via the detector) and without the need to communicate with a remotely located server or data provider.

One embodiment contemplates the use of a wireless communication tag. Generally speaking, this tag includes an electronic circuit with information stored thereon. The tag can be activated by a nearby reader device so as to wirelessly transmit the information to the nearby reader device. Information stored on the wireless communication tag pertains to the product within the container or packaging which the tag is associated. This information may be directly read and displayed by the device, or the information from the tag may enable the user, via the device, to engage in the web-based or remote access methods described below.

The wireless communication tag used in the following aspects of the present invention may be an NFC tag, an RFID tag, or a Bluetooth device. Preferably, it is an NFC tag.

A "passive tag" is defined as a tag without its own source of power. When a passive tag receives an electromagnetic (EM) signal from a nearby reader device, a portion of the energy of the signal is converted into a current, thereby powering (and activating) the tag. Passive tags are therefore only capable of transmitting information when activated by a nearby reader device. Passive tags are cheap to produce, and so are well suited for use in disposable or short-life intelligent packaging.

On the other hand, an "active tag" is defined as a tag with its own source of power. Active tags are therefore capable of performing functions other than the simple transmission of information to a reader device. Furthermore, they can perform these additional functions without requiring power from a nearby reader device for activation. Active tags may respond to EM signals, radio signals, or visible or invisible (e.g., infrared) light.

One or more tags may be embedded into a body of the packaging, by insert or over moulding, particularly where one or more active tags are used. Moreover, it may be embedded into a material of the body of the packaging, the container, the dispenser (if present, and/or closure of the container itself. Because the tag is embedded, it is not possible to tamper or copy the tag without visibly altering the appearance of the packaging. Accordingly, counterfeiting is prevented. The risk of the tag detaching from the packaging is also reduced, thereby improving the durability of the product packaging.

FIGS. 5B through 6B show how an inductive foil and/or a tag 50 could be captured or attached to the disc 30 along its inner facing. The act of affixing the closure 10 could be sufficient to hold the tag/foil 50 in place. Alternatively, the tag 50 could be provided with an adhesive, including a water soluble adhesive.

The tag 50 may include additional indexing apertures 53 that correspond to posts 27, at any one of inner facing surfaces of the cap 20, such as central section 24*a*. Similar structures could be provided on plate 30 for similar purposes. Provided tag 50 is formed from a sufficient pliable material and, further, that the wire coil portion 54 of the tag 50 is omitted from these sections, posts 27 (and/or posts on the plate 30) could be formed with a sharpened edge or spike so as to pierce the substrate of the tag 50, thereby eliminating the need for indexing (although the appendage bridge 51 of the tag 50 must still be aligned to ensure it: (a) is not compromised when the closure 10 assembled and separately attached to the container, and (b) remains frangible as intended).

Additionally or alternatively, the central aperture 52 of tag 50 may be uniquely shaped to cooperate with the cylinder 23 or receptacle 33. The unique shape may be imparted by inclusion of one or more notches or flanges or in the cross sectional shape of the components 23, 33 and the aperture itself 52 (i.e., while illustrated in the Figures as all having a circular shape, it may be possible to rely upon a polygon, oval, or other curved or curvilinear shape so as to ensure the tag 50 is only received when placed in a specific orientation). This approach accomplishes the same function as unique spacing of the aperture 53 and posts 27, by allowing the tag to be seated only when it is at a specific position, thereby positioning the appendage 51 at a specific orientation.

The result of the foregoing unique features ensures the tag 50 is positioned specifically relative to the formations at the cap and sealing plate interface and, further, that the tag 50 will remain in place as the closure is rotated (including to generate the forces contemplated by the action of ribs 22, 32, and/or 108). Thus, shearing force will break the thinned neck 51 of tag 50, including a portion of the wire coil 54*a*. In turn, this causes a detectable change in the wireless characteristics of the tag (e.g., frequency, resistance, capacitance, etc.). By equipping a mobile computing device having a reader with appropriate applications and/or software, it becomes possible to detect when the closure has been opened for the first time. In turn, this enables any combination of the verification, authentication and/or anti-counterfeiting features contemplated herein.

In other embodiments, the tag may interact with the device to update the information on the tag. This update could impose a new dispensing regime, prevent use under certain conditions, or otherwise inform the traits of the dispenser is used in the future. For example, temporal thresholds could be incorporated and/or altered in this manner so as to impose a minimum time or some other time-based restriction. In the same manner, quantitative thresholds could be employed to impose maximums or other limitations, e.g., by adjustment of the duration of dispensing, the flow rate (via changes to the pumping or outlet port), etc. Finally, by tracking dispensing events, proper dosing (or, via the foregoing thresholds) can be ensured for products requiring such monitoring.

A power source can be provided in order to enhance and/or selectively enable the wireless functionality. This power source may be in the form of a thin-printed, coin, button cell, cylindrical or other type of battery, with the recess 24 providing an ideal position therefore. Wire leads can be imprinted or attached to the cap 20 and/or plate 30 to provide electrical connection from the power source to the tag 60. Selection of the power source will be dictated by the need for electrical current, lifespan of the battery, and the size and shape(s) into which the power source must be integrated.

Alternatively, one or more transducers can be provided within or proximate to the tag. Generally speaking, transducers convert mechanical energy (i.e., in the form of motion) into electrical energy. Such transducers could be incorporated on one of the moving parts of a closure/container system. That is, as the components move through its range of motion, a cooperating transducer converts the energy from that movement into a usable electrical signal, e.g., to power an active tag. One example of a transducer is a piezoelectric device. As before, such transducers could be accommodated in the recess 24, along with appropriate electrical connectors.

Finally, the tag may be provided with one or more sensors, integrated chips, memory devices, and/or related circuitry (collectively referred to hereafter as "sensors and circuitry") to accomplish the aims described herein.

Web-based or Remote Access Verification, Authentication or Serialization Methods Components associated with one or more of the foregoing groupings can be combined with remotely located data servers. These data servers may merely store information or allow for dynamic and interactive aspects of the product to be developed. In particular, any number of arrangements could allow for authentication of the closure (and its associated container/products), cataloging of an end user's preferences or habits, serialization of the product itself by a middle party (e.g., a wholesaler or retailer), and other purposes as contemplated herein.

To the extent a remote data server is critical to these functions, systems and methods associated with this grouping will necessarily rely upon wireless communication. A preferred embodiment would involve the creation of an application or other software routine that is then installed on a user controlled computing device (e.g., a smart phone, a tablet, an e-reader, a laptop or mobile computer, etc.) equipped with appropriate wireless technologies (e.g., near field communications detectors, cameras, other sensors, etc.).

The application can include functionality to identify one or more users. The user(s)' information may be stored within the memory of the device running the application, remotely on a data server, or both (with periodic synchronization schemes provided). In some embodiments, the user may log-in using a profile in the application, so that any further activity during that log-in is automatically cataloged and indexed to that user. Algorithms could then be applied to further optimize the application and any information returned to the user from the remote servers (e.g., pertinent product information, opportunities to purchase related, ancillary products, etc.). Further still, geographic location devices associated with the computing device could be utilized to further augment the profile, algorithms, and/or overall user experience as might be appropriate to the circumstances.

In other embodiments, the remote storage of data allows for iterative treatment of data about the user, the closure, and/or the product within the container associated with the closure. That is, information about a particular closure may be created and added to as time goes on (this could prove particularly useful in an arrangement where a user might access information prior to and in support of a prospective purchase/use). Separately, from a supplier's perspective, data may be collected, tracked, and supplemented based on a wider scale.

Data storage may be leveraged on reader devices (e.g., mobile phones, laptop computers, etc.) that may be initially employed to interact with the closures and/or tags contemplated herein. As noted above, user profiles, dispensing and usage habits, and other traits can be stored on the reader device so as to interact directly with the closure/tag, thereby accomplishing the steps noted above.

In addition to authentication and/or anti-counterfeiting, the invention may include serialization by a middle party. That is, the closure may be formed with components from any combination of the groupings above, while the middle party provides a remote data server. Here, the middle party could create or assign product-specific information to a specific closure based upon the circumstances of the transaction by which the end user comes into possession of the closure. As above, this serialization could include an iterative element by which subsequent communications/requests from the end user about the specific closure are further tracked and leveraged. As above, a middle party could be a wholesaler, a retailer, a distributor within a supply chain, or any other entity that intervenes from the initial manufacture and containment of the product (via the inventive closure) and the final end user.

In any one or combination of the foregoing embodiments, the information pertaining to the product, either actively or passively associated with the tag/product or stored remotely as part of a remotely-based scheme, may include one or more of the following:

- A product identifier code
- A product serial number
- An expiry date (where the product is perishable)
- A link to a website address containing information about the product
- A location of origin
- Temperature(s) experienced by the product
- Force(s) applied to the product
- Humidity experienced by the product
- Movements experienced by the product
- Condition of perishable product
- Quantity of dispensed product The sensors and other circuitry that might be useful in combination with the tags include any one or more of:

- A thermocouple (for measuring temperature)
- A strain gauge (for measuring forces)
- An accelerometer (for measuring shocks, movements, and/or tilting of the product)

These are non-exhaustive lists. Indeed, given that NFC tags of the type discussed in this application can store data typically up to 8 kB, it is envisioned that any suitable combination of types of information could be used.

As noted above, the closure and method of closing contemplated herein provides one or more indicators for the user to easily determine whether the container has been compromised (i.e., without the user's knowledge, previously opened and/or surreptitiously adulterated/altered and then resealed). Therefore, methods of detecting counterfeit products, methods of serializing a product for subsequent, product- or user-specific datatracking, methods of authenticating the origin, contents, post-manufacturing history, and other characteristics of a closure associated with a specific product, and other methods are disclosed and encompassed by this disclosure.

Generally speaking, the structures and objectives described above could be used to any one or combination of the following:

- Customer engagement: consumers can interact with the product and the brand, as well as provide basic information on topics such product use, container recycling, product and/or container life cycle, etc.
- Create dashboards: display real time and/or historical data and reports thereof
- Metrics: track customer usage of products, as well as assist in manufacturing processes and sales analytics
- User profiles: the data and tracking can be instrumental to create unique user profiles and experiences
- Reminders: usage and associated data can be used remind consumers of critical events (e.g., the need to purchase additional products, recommendations on related items, etc.)
- Recyclable and/or Removable Components With further reference to the structures identified above, the flange 26 seals the interface of the cap 20 and plate 30 so as to encase the tag 50 and prevent tampering or access thereto. In this manner, the tag is also not exposed to moisture until the closure 10 is forcibly disassembled.

Thus, when the tag 50 is affixed with water soluble adhesives, the tag 50 will lose its adhesion to the aforementioned parts only when the closure assembly is destroyed (as might be the case during the initial stages of a recycling operation).

Alternatively, the connection of cap 20 and plate 30 may be by way of a pull-tab style insert. Here, perforations or weakened points on the cap 20 and/or disk 30 allow for a user to disconnect a section approximately the size of tag 50 from the cap 20 and/or plate 30 so as to expose and allow the removal/disposal of tag 50. A pull-tab or other removable section could be in addition to or in place of the formations 29, 39 otherwise needed to encase the tag 50. Further, if used, the pull-tab/perforated sections would act as a natural and obvious sign of tamper-evidence.

If used, the removable sections may be formed distinctly and separately from the boundary created by: (a) the disk 30 and the cap 20; and/or (b) the central section 24 and the remainder of the cap 20. Once the formation 27 is removed, it becomes possible to remove and dispose of the non-recyclable portions of the closure 10. In this manner, the closure 10 not only provides the anti-counterfeiting and informational purposes contemplated herein, but enables the remaining structures to be made from PCR and/or otherwise 100% recyclable and/or reusable materials.

All components should be made of materials having sufficient flexibility and structural integrity, as well as a chemically inert nature. The materials should also be selected for workability, cost, and weight. Common polymers amenable to injection molding, extrusion, or other common forming processes should have particular utility, although metals, alloys, and other composites may be used in place of or in addition to more conventional container and closure materials.

In various aspects, a closure according to the inventions contemplated herein may have any combination of the following:

- A cap having a panel and a peripheral skirt extending axially away from a bottom facing of the panel, wherein a sealing flange, plate engagement features, and a plurality of tag engagement posts are positioned on the bottom facing with the sealing flange positioned coaxially within the skirt and the plate engagement features and the plurality of tag engagement posts arranged within an area defined by the sealing flange;
- Wherein the cap includes at least one axial wall extending from the bottom facing to form a plug seal with a container neck edge;
- A sealing plate having at least one peripheral stopper to engage a corresponding stopper formed on s container and cap engagement features provided on a top facing, said sealing plate sized to be received within the skirt;
- Wherein the plate engagement features include one or more beads, grooves, or snap fittings formed on a radial facing of the cap which are received in a cooperating formations, provided as cap engagement features, on a radial facing of the sealing plate;
- Wherein at least two separate and axially spaced apart beads, grooves, or snap fittings are included as plate engagement features and at least two separate and axially spaced apart cooperating formations are included as cap engagement features so that a first set of plate and cap engagement features are coupled when the cap is initially attached to the plate and a second set of plate and cap engagement features are subsequently coupled after the closure is tightened onto a container;
- Wherein the plate engagement features include one or more axially extending ribs or projections, said axially extending ribs or projections received within a corresponding arcuate gap or slot formed on the top facing of the sealing plate and wherein said corresponding arcuate gap or slot allows the sealing plate to rotate freely in comparison to the cap for a limited range of motion;
- Wherein the cap includes a central engagement cylinder on the bottom facing, said central engagement cylinder cooperating with a corresponding engagement cylinder formed on the top facing of the sealing plate;
- Wherein the radial facing of the cap is positioned on the sealing flange;
- Wherein the radial facing of the cap is positioned on the central engagement cylinder;
- Wherein the radial facing of the sealing plate is positioned on a peripheral groove on the top facing;
- Wherein the radial facing of the sealing plate is positioned on the corresponding engagement cylinder;
- A wireless tag having at least one frangible appendage, said wireless tag positioned between the cap and the plate so that, upon initial assembly, the tag is carried on the engagement posts;
- Wherein the cap and sealing plate are coupled together via the cap and plate engagement features;
- Wherein the wireless tag includes apertures proximate to the frangible appendage;
- Wherein the wireless tag includes peripheral apertures spaced apart and sized to receive the engagement posts;
- Wherein the frangible appendage ruptures when, after the closure is initially tightened onto a container, the closure is loosened to enable the limited range of motion to sever the frangible appendage.

Tags appropriate for use in the various aspects contemplated or disclosed above will have a thin wire antenna formed on a backing material. Preferably, the backing material is made of paper or other low-cost substrates that can be easily incorporated into manufacturing procedures. The substrate is amenable to adhesives and/or the stresses associated with manufacturing and rotating, as described above.

Tags for NFC and other applications (e.g., RFID) can be found from any number of suppliers available as of the date of this application. These tags include antenna and may be writable or permanently encoded, depending upon the nature of the informational attributes desired, the physical size of the tag, and/or the manufacturing capabilities.

In view of the construction of closure 10 and particularly the secure attachment of cap 20 to plate 30, tag(s) 50 are concealed under or within the closure 10, so as to prevent unwanted tampering or removal from the closure. As such, various methods of manufacturing a smart closure, of authenticating a product, and of recycling a smart closure are contemplated. These various method steps are inherent to the discussion of constructing and assembling the closure provided above, but these methods may include any combination of the following:

- Forming a cap with a bottom facing including a sealing flange positioned coaxially within a skirt and plate engagement features and a plurality of tag engagement posts arranged within an area defined by the sealing flange;
- Forming a sealing plate having cap engagement features;
- Positioning a wireless tag proximate to the tag engagement posts and coupling the cap to the sealing plate by way of the cap engagement features and the plate engagement features, thereby forming a smart closure;
- Rotatably attaching the smart closure to a container having a neck so that, as the smart closure is initially urged into contact with the container at the neck, the wireless tag is compressed in place and thereafter moves in concert with the cap;
- Providing a reader device to communicate with the smart closure to detect informational attributed encoded on the wireless tag;

Providing a remote data server configured to communicate with the reader device to provide authentication and/or other informational attributes about products confined/sealed in the container by the smart closure;

Wherein, when the smart closure is removed from the container neck, the wireless tag provides a distinct signal to the reader device in comparison to a signal provided when the smart closure is initially urged into contact with the container;

Providing tamper or non-authentic notification to the reader device in response to the distinct signal;

Wherein the tag is formed with a frangible appendage positioned along a temporarily rotating interface between the cap and the plate; and Wherein the temporarily rotating interface is created and defined by at least one rib or projection formed on the bottom facing of the cap, said rib or projection received within a slot or gap formed on the sealing plate proximate to the cap engagement features.

Although the present embodiments have been illustrated in the accompanying drawings and described in the foregoing detailed description, it is to be understood that the invention is not to be limited to just the embodiments disclosed, and numerous rearrangements, modifications and substitutions are also contemplated. The exemplary embodiment has been described with reference to the preferred embodiments, but further modifications and alterations encompass the preceding detailed description. These modifications and alterations also fall within the scope of the appended claims or the equivalents thereof

The invention claimed is:

1. A smart closure, rotatably attachable to a container, comprising:

a cap, the cap having a panel, a peripheral skirt extending axially away from a bottom facing of the panel and a sealing flange, plate engagement features, and a plurality of tag engagement posts all positioned on the bottom facing, said sealing flange being arranged coaxially within the skirt and said plate engagement features and plurality of tag engagement posts being arranged within an area defined by the sealing flange;

a sealing plate having at least one peripheral stopper to engage a corresponding stopper formed on a container, and cap engagement features provided on a top facing, said sealing plate being sized to be received within the skirt of the cap;

a wireless tag having at least one frangible appendage, said wireless tag being positioned between the cap and the plate so that the tag is carried on the engagement posts;

wherein the cap and sealing plate are coupled together via the cap and plate engagement features to form a closure with the wireless tag held between the cap and the sealing plate; and wherein, after the closure has been tightened onto a container, the frangible appendage ruptures when the closure is thereafter loosened by rotation relative to the container.

2. The smart closure of claim 1 wherein the plate engagement features of the cap include one or more axially extending ribs or projections, said axially extending ribs or projections received within a corresponding arcuate gap or slot formed on the top facing of the sealing plate and wherein said corresponding arcuate gap or slot allows the sealing plate to rotate freely in comparison to the cap for a limited range of motion.

3. The smart closure of claim 1 wherein the plate engagement features include one or more beads, grooves, or snap fittings formed on a radial facing of the cap which are received in a cooperating formations, provided as cap engagement features, on a radial facing of the sealing plate.

4. The smart closure of claim 3 wherein at least two separate and axially spaced apart beads, grooves, or snap fittings are included as plate engagement features and at least two separate and axially spaced apart cooperating formations are included as cap engagement features so that a first set of plate and cap engagement features are coupled when the cap is initially attached to the plate and a second set of plate and cap engagement features are subsequently coupled after the closure is tightened onto a container.

5. The smart closure of claim 3 wherein the radial facing of the cap is positioned on the sealing flange.

6. The smart closure of claim 3 wherein the radial facing of the sealing plate is positioned on a peripheral groove on the top facing.

7. The smart closure of claim 3 wherein the cap includes a central engagement cylinder on the bottom facing, said central engagement cylinder cooperating with a corresponding engagement cylinder formed on the top facing of the sealing plate.

8. The smart closure of claim 3 wherein the cap includes at least one axial wall extending from the bottom facing to form a plug seal with a container neck edge.

9. The smart closure of claim 1 wherein the cap includes a central engagement cylinder on the bottom facing, said central engagement cylinder cooperating with a corresponding engagement cylinder formed on the top facing of the sealing plate.

10. The smart closure of claim 9 wherein the radial facing of the cap is positioned on the central engagement cylinder.

11. The smart closure of claim 9 wherein the radial facing of the sealing plate is positioned on the corresponding engagement cylinder.

12. The smart closure claim 1 wherein the cap includes at least one axial wall extending from the bottom facing to form a plug seal with a container neck edge.

13. The smart closure of claim 1 wherein the wireless tag includes apertures proximate to the frangible appendage.

14. The smart closure of claim 1 wherein the wireless tag includes peripheral apertures spaced apart and sized to receive the engagement posts of the cap.

* * * * *